US006270035B1

(12) United States Patent
Lahaussois

(10) Patent No.: US 6,270,035 B1
(45) Date of Patent: Aug. 7, 2001

(54) SUPPORTING APPARATUS FOR A ROLL OF PAPER TOWELS, TOILET TISSUE OR THE LIKE

(76) Inventor: Pierre Lahaussois, 15 Crockett St., Rowayton, CT (US) 06853

( * ) Notice: Subject to any disclaimer, the term of this patent is extended or adjusted under 35 U.S.C. 154(b) by 0 days.

(21) Appl. No.: 09/680,040

(22) Filed: Oct. 5, 2000

(51) Int. Cl.[7] ..... B65H 16/04

(52) U.S. Cl. ..... 242/597.7; 242/592; D6/521; D6/522

(58) Field of Search ..... 242/597.7, 592, 242/130.2, 134, 141; D6/521, 522, 523; 221/45, 283

(56) References Cited

U.S. PATENT DOCUMENTS 755,657 3/1904 Harrington .
1,238,571 8/1917 Rosenthal .
2,256,204 9/1941 Jameson .
3,988,810 11/1976 Emery .
5,098,055 3/1992 Leonian .
5,323,995 6/1994 Grittman et al. .
5,692,639 12/1997 Lahaussois et al. .

*Primary Examiner*—John Q. Nguyen
(74) *Attorney, Agent, or Firm*—Schweitzer Cornman Gross & Bondell LLP

(57) ABSTRACT

A supporting apparatus for a roll of paper towels or a similar item. The device has a section of lanyard or other flexible material fastened along its lower region to an adjoining collar with two arms extending in generally opposite directions from each other. The arms provide a surface on which a roll of paper towels can rest. A series of enlargements and a spherical dual-passage collar along the upper region of the lanyard together provide a releasable loop of adjustable size by which the device is hung. The holding device has confining elements at the distal ends of the arms. A user can easily attach a roll of paper towels or toilet tissue to the device by dropping the adjoining collar together with the arms through the hollow cylindrical core of the roll.

11 Claims, 3 Drawing Sheets

SUPPORTING APPARATUS FOR A ROLL OF PAPER TOWELS, TOILET TISSUE OR THE LIKE

RELATED CASE

This application is related to U.S. Pat. No. 5,692,639.

FIELD OF THE INVENTION

The present invention relates to a supporting apparatus for a roll of paper towels, toilet tissue or a similar item.

BACKGROUND OF THE INVENTION

A roll of paper towels loosely situated on a countertop together with other items might be difficult to find and inconvenient to use, e.g., requiring two hands to remove a towel from the roll. A variety of designs of paper towel holders and dispensers have therefore become popular items in households and commercial locations. These designs range from minimalist structures to elaborate devices with sophisticated lock and release mechanisms. U.S. Pat. No. 5,692,639 discloses a design for a paper towel holder that is relatively simple, yet functional and versatile. Its loop allows a user to fasten it temporarily to many types of fixtures, an improvement over several prior art devices that need to be fastened permanently to a surface. Its loop also allows the user to select the height of the towels, a feature that can keep the towels both accessible and out of the way. Its small size is an improvement over prior art devices that are bulky, especially where space is limited. Dual stop elements are an improvement because they allow the user to attach and remove the roll quickly and are simple to manufacture, while providing a novel means for holding the roll when it is in use. The holder is durable and lacks stress points that might otherwise be susceptible to early failure.

It is still desirable for a paper towel holder to be even simpler to use, e.g., by being easier for the user to attach and remove the roll of paper towels, to tear away a sheet of paper towels, and to fasten the paper towel holder to a fixture.

SUMMARY OF THE INVENTION

In view of the foregoing background, the apparatus of the present invention has several features. It allows a user to move it easily from one location to another. It has a releasable loop whose novel configuration can fasten temporarily to additional types of fixtures. It engages and disengages a roll of paper towels or tissues quickly. It is inexpensive to manufacture because it requires few parts, all of which are simple to construct and assemble. It occupies little space. It suspends paper towels at a height selected by the user, helping the user maximize workspace. It is lightweight, durable, and aesthetically attractive. It makes tearing off a towel from the roll easy. It accommodates rolls with a wide range of sizes, a useful feature for many of today's extra wide rolls that do not fit onto other holders.

In accordance with the features mentioned above, the apparatus of the present invention has a piece of lanyard or other flexible material fastened along its lower region to an adjoining collar that is between two arms extending outward from the adjoining collar in generally opposite directions. When in use, the lanyard extends through the core of the paper towels, and the roll rests along the arms. Along the upper region of the lanyard are means for fastening the apparatus to any of a variety of fixtures.

In one aspect of the invention, the adjoining collar has a spherical shape. A series of knots and a dual-passage collar, also spherical, along the upper region of the lanyard form an adjustable loop by which the apparatus is hung. Adjusting the loop varies the effective length of the lanyard section, which is typically long enough to give the user an option of positions from which to choose. The dual-passage collar also provides an additional advantage. Namely, its open-sided slot makes the loop releasable by allowing the user to remove the upper region of the lanyard laterally from the open-sided slot. Thus it is possible for the user to fasten the apparatus to additional types of fixtures, such as closet rails that are typically used for hanging clothes.

As a further aspect of the invention, the apparatus can have confining elements at the distal ends of the arms for holding a roll of paper towels therebetween, where each confining element comprises a section of a flexible, resilient material such as heavy monofilament. Each section of monofilament is predisposed to rest against the roll of paper towels to prevent the paper towels from unrolling.

The adjoining collar, arms, and flexible confining elements form a shape that fits through the hollow cylindrical core of most rolls of paper towels and the like. Therefore, to attach the roll of paper towels to the apparatus, the user simply drops the adjoining collar, arms, and confining elements through the core. Alternately, because the dual-passage collar is similarly small enough to fit through the core of most rolls, the user can also drop the dual-passage collar through an inverted core to attach the towels to the apparatus.

The configuration of the apparatus and the economy with which it may be provided make it ideally suited for use in marketing paper towels, toilet tissues and similar items, e.g., by distributing it as a giveaway device or by packing it inside the core of a roll of paper towels or tissues and then selling it together with the roll.

DESCRIPTION OF PREFERRED EMBODIMENTS

Figure 1:
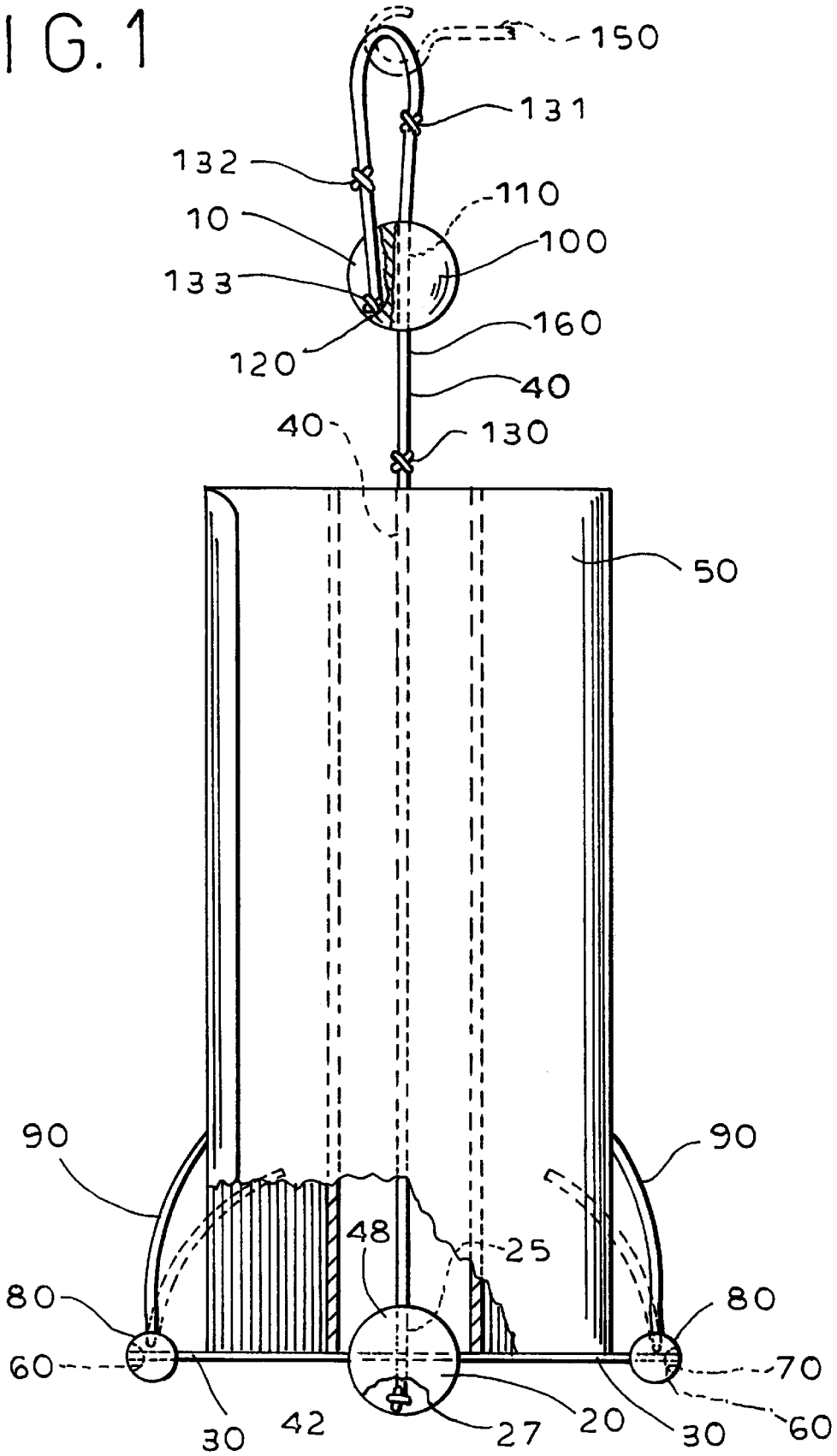
FIG. 1 is a front elevational view, partly in section, showing a roll of paper towels supported by the apparatus of the invention.

As shown in FIG. 1, the apparatus 10 has a lower adjoining collar 20, shown with a spherical shape, between two arms 30 extending out from the adjoining collar in opposite directions. A lanyard section 40 extends through an internal slot 25 inside the adjoining collar 20. A knot 42 along the lower region 48 of the lanyard 40 is engaged by a recess 27 within the adjoining collar 20 to prevent the adjoining collar from traveling below the knot 42. The lanyard 40 is shown extending through a hollow cylindrical core 45 of a roll of paper towels 50 that is being held by the apparatus 10, and the roll 50 is resting on the arms 30. Confining elements 60 are positioned at the distal ends 70 of the arms 30 to hold a roll of paper towels therebetween. Each confining element 60 has an abutment 80 supporting a section of heavy monofilament 90 that has an inward disposition. The monofilament 90 therefore rests along the outside towels of a roll 50 and presses the outer towels toward the center of the roll to keep the roll intact.

An upper dual-passage collar 100, here having a spherical shape, is positioned along the upper region of the lanyard 40. The dual-passage collar has an internal slot 110 through which the lanyard 40 extends and an open-sided slot 120 into which the lanyard can be inserted laterally. Knots 130, 131, 132, and 133 along the upper region of the lanyard section 40 together with the dual-passage collar 100 form an adjustable and releasable loop 140 that can be hung from a hook 150 (shown in phantom). The knots 130 and 131 are too wide to enter the internal slot 110 of the dual-passage collar. In this particular embodiment, the internal slot 110 of the dual-passage collar must therefore remain along the region 160 of the lanyard between knots 130 and 131. When the apparatus 10 is hung from a fixture and a roll of paper towels 50 is attached, gravity forces the lanyard section 40 down through the internal slot 110 until the knot 131 rests against the dual-passage collar 100 outside an opening 135 to the internal slot 110.

Figure 2:
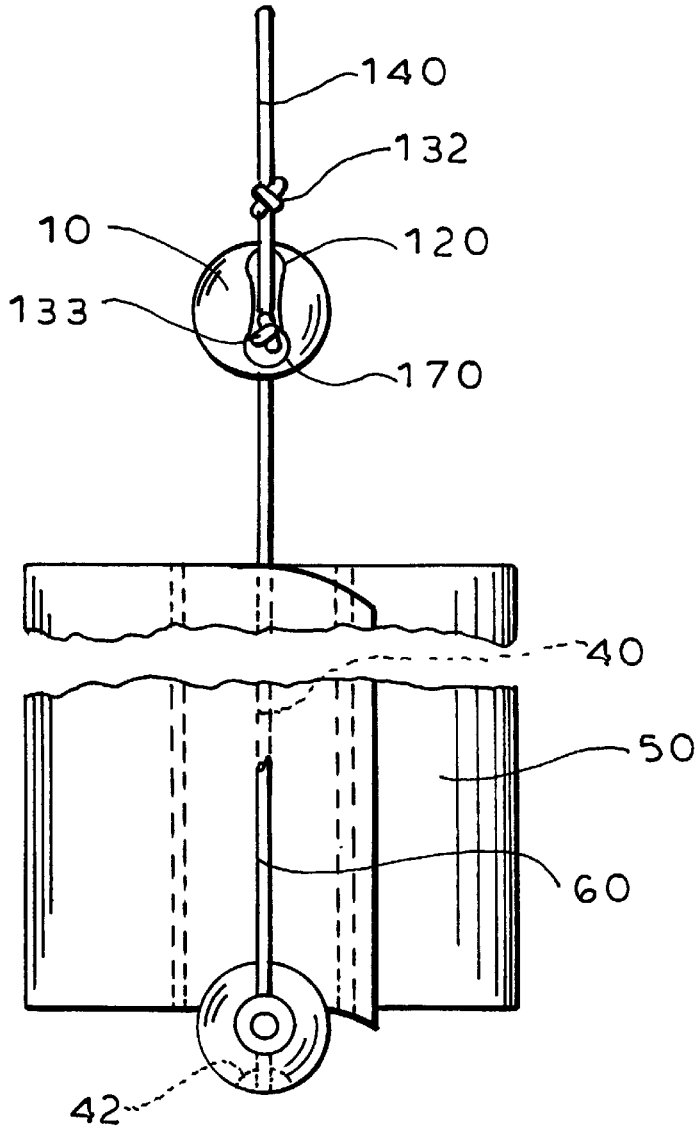
FIG. 2 is a side view, partly in section, showing a roll of paper towels supported by the apparatus of FIG. 1.

A side view of the holding device 10 is shown in FIG. 2. The open-sided slot 120 of the dual-passage collar has a recess 170 that can releasably engage one of several knots 132, 133 to allow the user to adjust the length of the loop 140. The user therefore has the option to fasten the apparatus to a fixure in one of two ways. First, for some 132, 133 such as hooks, the user can simply lower the loop 140 onto the fixure without ever removing the lanyard from the open-sided slot. For other fixtures, the user may first have to release the loop, then thread the lanyard through the fixture and insert the lanyard back into the open-sided slot.

Also shown in FIG. 2, a portion of the adjoining collar 20 is inside the cylindrical core 45 of the roll of paper towels 50 as the roll rests on the arms 30 (hidden in FIG. 2). This portion provides an obstacle within the hollow core 45 that limits the translation of the paper towel roll with respect to the apparatus 10 when it is attached to the apparatus. Thus the adjoining collar helps keep the lanyard 40 that is inside the cylindrical core 45 collinear with the longitudinal axis of the cylindrical core.

Figure 3:
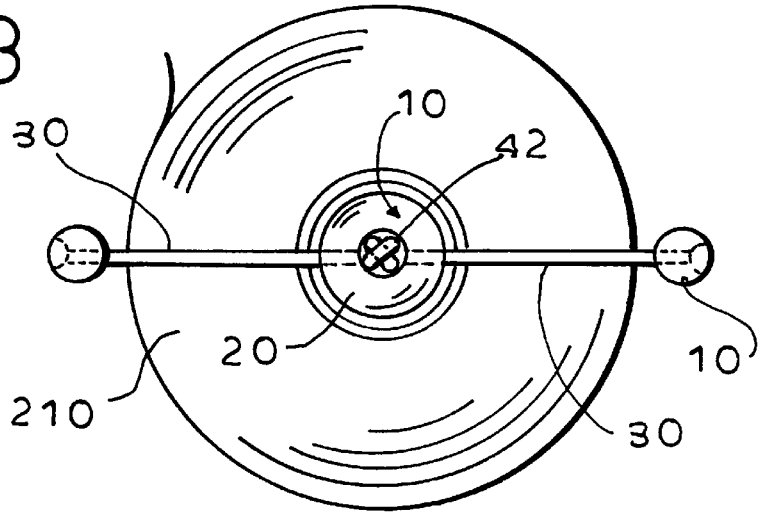
FIG. 3 is a bottom plan view showing the apparatus of FIG. 1.

As shown in FIG. 3, the arms 30 are relatively long and narrow. Because the arms are symmetric about the adjoining collar 20, they keep the roll in a stable upright position. However, the apparatus 10 would hold a paper towel roll equally well if the arms were slightly wider or were to have a different shape, e.g., curved (shown in phantom).

Figure 4:
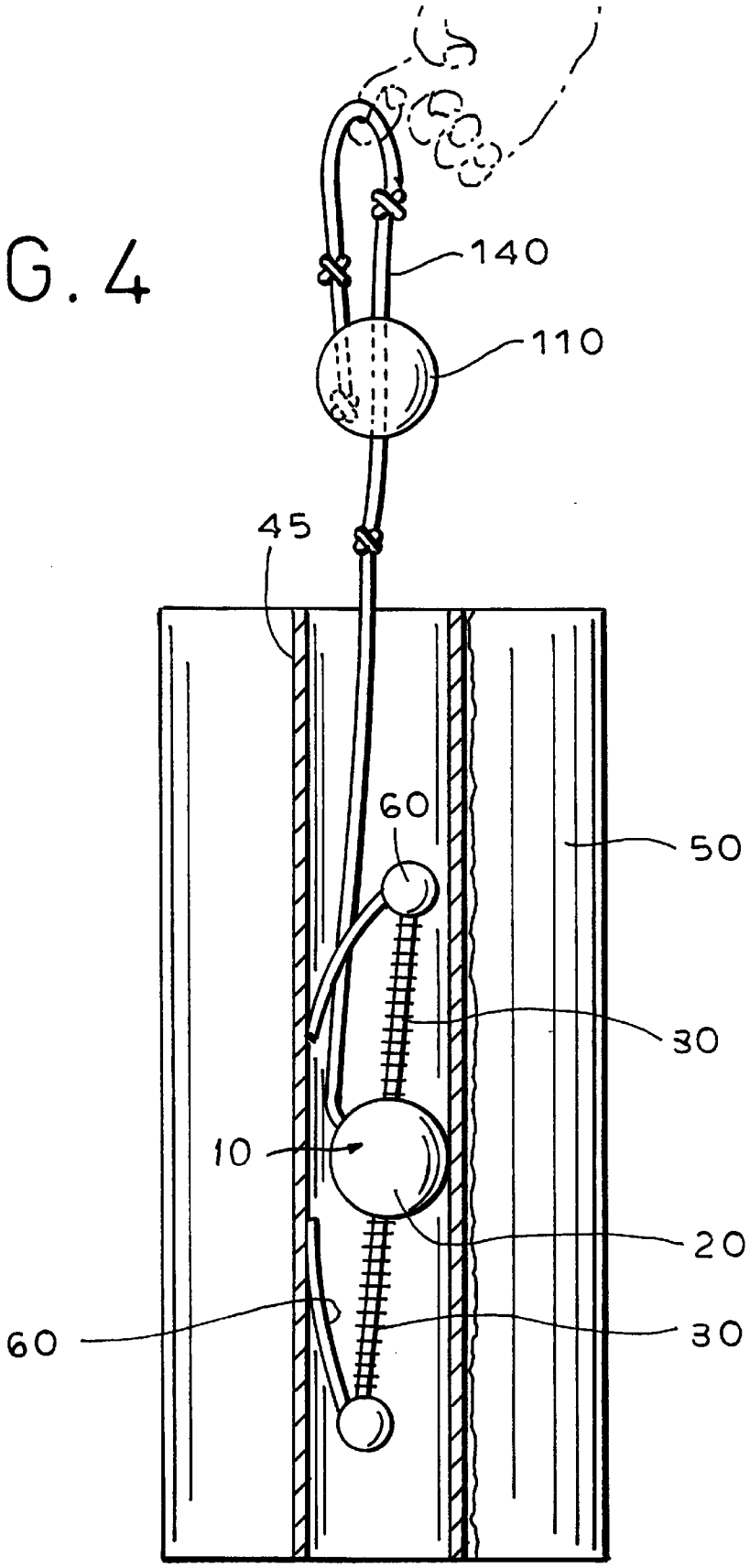
FIG. 4 is a cross-sectional view taken on the line 4—4 in FIG. 2, showing the apparatus of FIG. 1 being inserted through the hollow cylindrical core of a roll of paper towels.

As shown in FIG. 4, the adjoining collar 20, arms 30, and flexible confining elements 60 form a shape that the user can drop through the hollow cylindrical core 45 of the roll, and they are of a size to fit through the core of most rolls of paper towels and toilet tissues. When a roll is depleted, the user simply removes the empty roll by pulling the adjoining collar 20, arms 30, and confining elements 60 through the core. The user then attaches a new roll by dropping the adjoining collar 20, arms 30, and confining elements 60 through its core. Therefore the user does not need to remove the loop 140 of the apparatus from a fixture to replace an empty roll. Alternately, since the dual-passage collar 100 is also small enough to fit through the core of most rolls, a user has the option to drop the dual-passage collar instead through the hollow core of an inverted roll of paper towels to attach the roll, and to pull the dual-passage collar back through to remove the roll. However, this second method requires first removing the loop 140 from a fixture.

Figure 5:
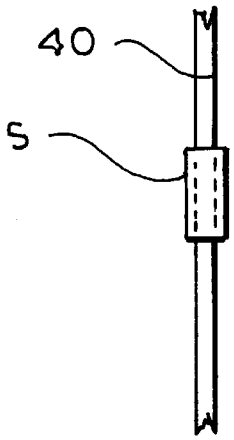
FIG. 5 is a fragmentary elevational view of a section of lanyard fitted with abutment sleeves.

In the modified form of the invention, shown in part in FIG. 5, enlargements are formed on the lanyard 40 by fixing sleeve-like elements S thereon, in place of the knots 42, 130–133. The sleeve-like elements conveniently may be short sections of deformable material, in either tubular or split tubular form. The sleeves S are positioned on the lanyard and crimped with a suitable tool so as to be locked in position. On the lanyard the sleeves form abutments and thus serve the same purpose and function as the knots.

The apparatus 10 is well suited for use in marketing paper towels, toilet tissues and similar items. One such example is by distributing it as a giveaway device with a manufacturer's name stamped onto both of its collars. A second example is by folding it inside the hollow core of a packaged roll of towels or tissues and then selling the combination as a premium item. The apparatus 10 is also well suited to be a substitute for holders that are unable to accommodate a roll of paper towels or toilet tissues with a larger than average girth, since the apparatus can accommodate towel rolls with a wide range of sizes.

Although the preferred embodiments of the present invention have been disclosed for illustrated purposes, those who are skilled in the art will appreciate that various modifications, addictions and the substitutions are possible, without departing from the scope and spirit of the invention as set forth in the accompanying claims.

I claim:

1. A holder for suspending a generally cylindrical roll of paper tissues, where the cylindrical roll has an inner structure that provides an open-ended internal passage extending from one end of the roll through the inner structure to a substantially opposite end of the roll and has paper tissues outside the inner structure, comprising:

(a) an adjoining collar;

(b) a first arm extending out from the adjoining collar;

(c) a second arm substantially equal in length to the first arm extending out from the adjoining collar in a direction substantially opposite the first arm, wherein the adjoining collar, first arm, and second arm have a size, shape, and orientation that permit the collar and the first and second arms to enter, exit, and travel within the internal passage of the cylindrical roll;

(d) a lanyard section engaging the adjoining collar, wherein the lanyard section has a length greater than the length of the internal passage of the generally cylindrical roll; and (e) means for fastening the holder to a fixture.

2. The holder of claim 1, wherein distal ends of the first and second arms are spaced apart to support the cylindrical roll therebetween.

3. The holder of claim 2, wherein at least one arm extending out from the adjoining collar has a confining element at a distal end of said one arm.

4. The holder of claim 3, wherein the confining element comprises an abutment at the distal end of the arm.

5. The holder of claim 4, wherein the confining element further comprises a section of resilient monofilament attached at one end to the abutment.

6. The holder of claim 5, wherein each of the first and second arms has a confining element.

7. The holder of claim 6, wherein the adjoining collar has a spherical shape.

8. The holder of claim 1, wherein the means for fastening the holder to a fixture comprise a first enlargement and at least one additional enlargement along the upper region of the lanyard section, a dual-passage collar along the upper region of the lanyard section having an internal slot through which the lanyard section extends and an open-sided slot into which the lanyard section can be inserted laterally, and a recess along the open-sided slot for engaging an enlargement to form a loop above the dual-passage collar.

9. The holder of claim 8, wherein the dual-passage collar has a spherical shape for freely entering, exiting, and traveling within the internal passage of the cylindrical roll.

10. The holder of claim 8, wherein said enlargements are formed by knots in said lanyard.

11. The holder of claim 8, wherein said enlargements are formed by sleeve elements attached to said lanyard.

* * * * *